US006668487B2

(12) United States Patent
Vesey

(10) Patent No.: US 6,668,487 B2
(45) Date of Patent: Dec. 30, 2003

(54) SYSTEM AND METHOD FOR APPLYING AN ANIMAL ACCESS DOOR TO AN INCLINED SURFACE

(76) Inventor: Michael P. Vesey, 1106 Fieldcrest Ct., Chalfont, PA (US) 18914

( * ) Notice: Subject to any disclaimer, the term of this patent is extended or adjusted under 35 U.S.C. 154(b) by 0 days.

(21) Appl. No.: 09/981,601

(22) Filed: Oct. 18, 2001

(65) Prior Publication Data

US 2003/0074841 A1 Apr. 24, 2003

(51) Int. Cl.[7] ..... E05D 15/48
(52) U.S. Cl. ..... 49/169; 52/72; 119/501
(58) Field of Search ..... 49/169; 52/72; 119/484, 501

(56) References Cited

U.S. PATENT DOCUMENTS

| | | | | |
|---|---|---|---|---|
| 619,688 A | * | 2/1899 | Linn | 119/501 |
| 4,022,263 A | * | 5/1977 | Beckett et al. | 119/484 |
| 4,291,645 A | * | 9/1981 | Cruchelow et al. | 119/484 |
| 5,165,366 A | * | 11/1992 | Harvey | 119/501 |
| 5,335,461 A | * | 8/1994 | Petersen et al. | 52/72 |

FOREIGN PATENT DOCUMENTS

| | | | |
|---|---|---|---|
| EP | 750707 | * | 3/1995 |
| JP | 8-27940 | * | 1/1996 |

* cited by examiner

*Primary Examiner*—Jerry Redman
(74) *Attorney, Agent, or Firm*—LaMorte & Associates

(57) ABSTRACT

A system and method for applying an animal access port to an inclined surface, such as an inclined cellar door. The system includes rail elements that are applied to the inclined surface on either side of an opening that has been cut through the inclined surface. The rail elements create tracks along the sides of the opening. A dormer structure is provided. The dormer structure has walls and a top surface that spans the walls to define an interior space within the dormer structure. However, the dormer structure has no bottom surface, and is thus open at its bottom. One of the walls of the dormer structure supports a door. The dormer surface can be placed in the tracks created by the rail elements. The tracks retain the dormer structure in place over the opening in the inclined surface. The dormer structure protects the opening in the inclined surface and provides access to the opening through the door in the wall of the dormer structure.

8 Claims, 3 Drawing Sheets

SYSTEM AND METHOD FOR APPLYING AN ANIMAL ACCESS DOOR TO AN INCLINED SURFACE

BACKGROUND OF THE INVENTION

1. Field of the Invention

The present invention relates to animal access doors of the type that enable a pet dog or cat to enter or exit a building unassisted. More particularly, the present invention relates to the structure of animal access doors and the methods of installing such animal access doors to different surfaces.

2. Description of the Prior Art

The prior art record is replete with different types of animal access doors. The simplest animal access doors are just small openings that are cut through the door or wall of a house so that a dog or cat can enter or exit the house at will. The cut opening is typically covered by a flap that can be swung open by the pet as the pet passes through the opening. A problem associated with such swinging flap animal access doors is that they enable strange animals or wild animals access to the house. Furthermore, such swinging door access openings do little to keep out bad weather and wind. Rather, such swinging flap animal access doors rely upon their vertical orientation to keep the flap closed and the weather out. Consequently, such swinging flap animal access doors are typically applied to house doors that have some type of overhang protection to keep weather from directly bearing on the surface of the door.

To help prevent strange animals or wild animals from entering animal access doors, high-tech animal access doors have been developed. Such high-tech animal access doors only open or unlock when a specific pet approaches the animal access door. Such animal access doors contain sensors that detect a magnet or signal emitter that is carried on the collar of the pet. As the pet approaches the door, the collar on the pet is detected and the animal access door briefly opens or unlocks. Such prior art animal access doors are exemplified by U.S. Pat. No. 4,991,350, to Kirk, entitled Electromagnetically Controlled Cat Flap.

Since very few pets are trained to close doors, both hanging flap access doors and high tech access doors typically rely upon gravity to close the door after the animal has passed. Consequently, such animal access doors must be applied to vertical surfaces so that gravity will return the animal access door to a vertical position. However, there are many surfaces in a house that are not vertical. One such surface is an inclined cellar door. Inclined cellar doors are typically used to cover external stairways that lead directly to the cellar of a home from the outside. Inclined cellar doors are popular with many homeowners because they provide a large access port to the cellar that enables large objects, such as boilers, water heaters, pool tables and the like to be more readily moved into and out of the cellar.

Many pet owners keep their pets in their cellars. It would be highly desirable for a home to have a pet access door that leads directly from the cellar to the outside. However, conventional animal access doors cannot be applied to inclined cellar doors. If they were, they would not close and would allow weather and strange animals to enter the cellar. Furthermore, the unclosed animal access door at the top of the cellar stairwell would present a falling hazard to children and unwary animals.

A need therefore exists for a new animal access door that is adapted to be applied to an inclined surface, such as an inclined cellar door, wherein the animal access door keeps out the weather and does not present a falling hazard. This need is met by the present invention as described and claimed below.

SUMMARY OF THE INVENTION

The present invention is a system and method for applying an animal access port to an inclined surface, such as an inclined cellar door. The system includes rail elements that are applied to the inclined surface on either side of an opening that has been cut through the inclined surface. The rail elements create tracks along the sides of the opening. A dormer structure is provided. The dormer structure has walls and a top surface that spans the walls to define an interior space within the dormer structure. However, the dormer structure has no bottom surface, and is thus open at its bottom. One of the walls of the dormer structure supports a door. The dormer surface can be placed in the tracks created by the rail elements. The tracks retain the dormer structure in place over the opening in the inclined surface. The dormer structure protects the opening in the inclined surface and provides access to the opening through the door in the wall of the dormer structure.

The dormer structure can be selectively removed from the track of the rail elements. In its place, a solid plate can be positioned, using the track of the rail elements. The result is a solid cover that protects the opening in the inclined surface from any access.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention animal access door system can be applied to any inclined surface, such as a roof, the present invention is particularly well suited for application to an inclined cellar door. As such, the present invention animal access door system will be described and illustrated as being applied to an inclined cellar door in order to set forth the best mode contemplated for the invention.

Figure 1:
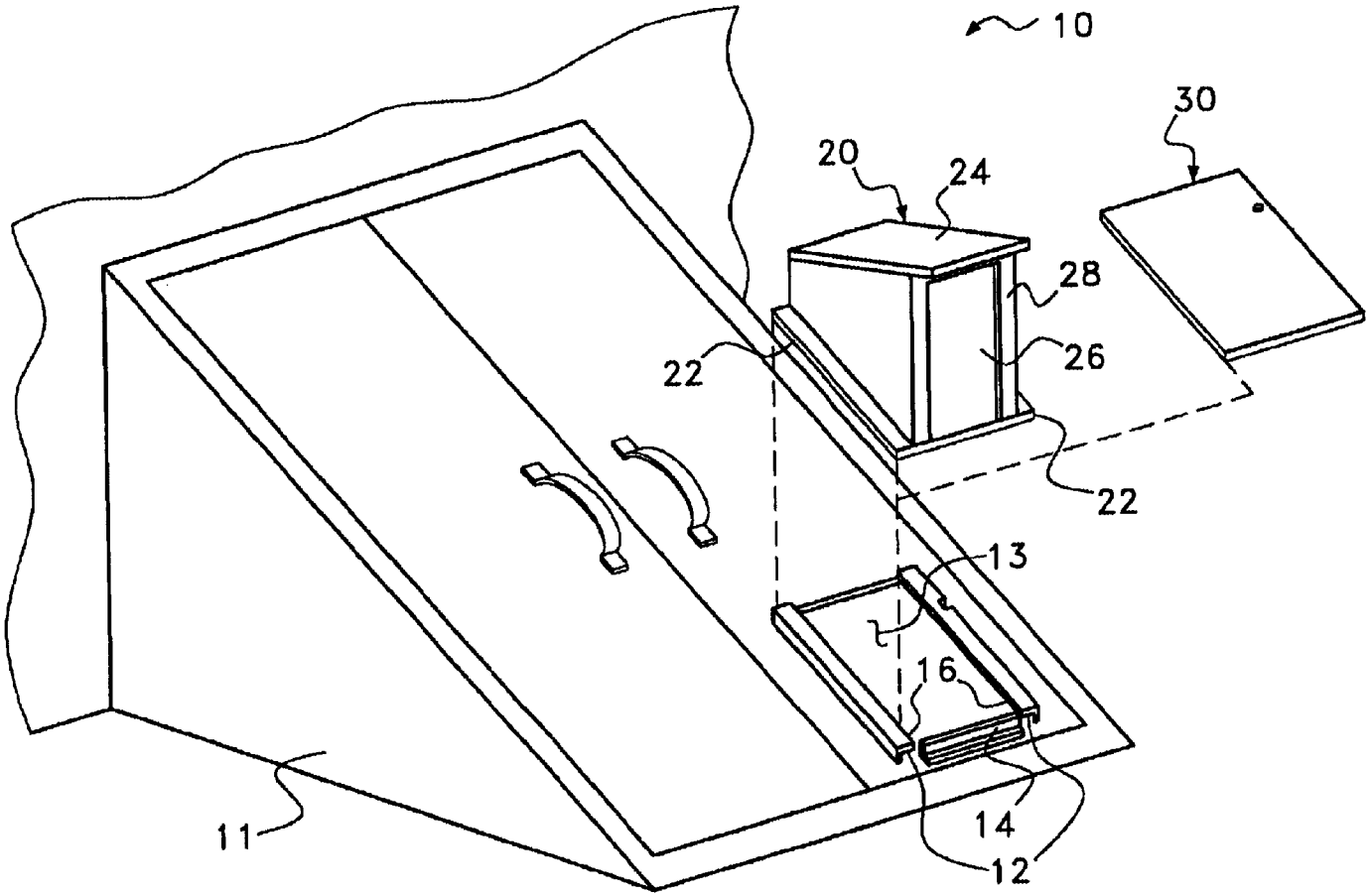
FIG. 1 is an exploded perspective view of an exemplary embodiment of the present invention system being applied to an inclined cellar door.

Referring to FIG. 1, a typical inclined cellar door 11 is shown. Such inclined cellar doors commonly cover stairwells that lead directly into the cellar of a home. Inclined cellar doors are typically manufactured of steel, however, in older homes wooden inclined cellar doors can still be found. An opening 13 is cut into the inclined cellar door 11 over the first step of the stairwell. The size of the opening 11 is dependent upon the size of the pet that will be passing through the opening 13 and the size of the animal access door system 10 selected.

The present invention animal access door system 10 is a modular system that consists of multiple interconnecting components. Guide rails 12 are attached to the inclined cellar door 11 on either side of the opening 13. A stop rail 14 is also positioned between the guide rails 12 at the bottom most edge of the opening 13. The guide rails 12 create tracks 16 on the exterior of the inclined cellar door 11 along the sides of the opening 13. Either a dormer structure 20 or a safety panel 30 can be placed into the tracks 16 over the opening 13. The dormer structure 20 is used when access to the opening 13 is to be provided to a pet. The dormer structure 20 can be removed and replaced with a safety panel 30 if no pet is to be provided, or if the family and pet are away on vacation.

From FIG. 1, it can be seen that the dormer structure 20 has lip extensions 22 that pass into the tracks 16 that are created by the guide rails 12 on either side of the opening 13. The protruding lip extensions 22 pass into the tracks 16 from the top of the tracks 16. The protruding lip extensions 22 advance along the tracks 16 until they abut against the stop rail 14 at the bottom of the opening 13. Once at this location, the dormer structure 20 is symmetrically disposed over the opening 13 in the inclined cellar door 11. The engagement of the lip extensions 22 on the dormer structure 20 with the track 16, prevents the dormer structure 20 from moving in any direction other than back out along the plane of the tracks 16.

The dormer structure 20 is a four sided structure having no bottom and an inclined top surface 24. The slope of the top surface 24 of the dormer structure 20 is opposite the direction of the slope of the inclined cellar door 11. The four side walls of the dormer structure are vertical and remain vertical even when the dormer structure 20 is attached to the inclined cellar door. A flap door 26 is present in the front wall 28 of the dormer structure 20. The flap door 26 covers an access opening through which a pet can pass.

Figure 2:
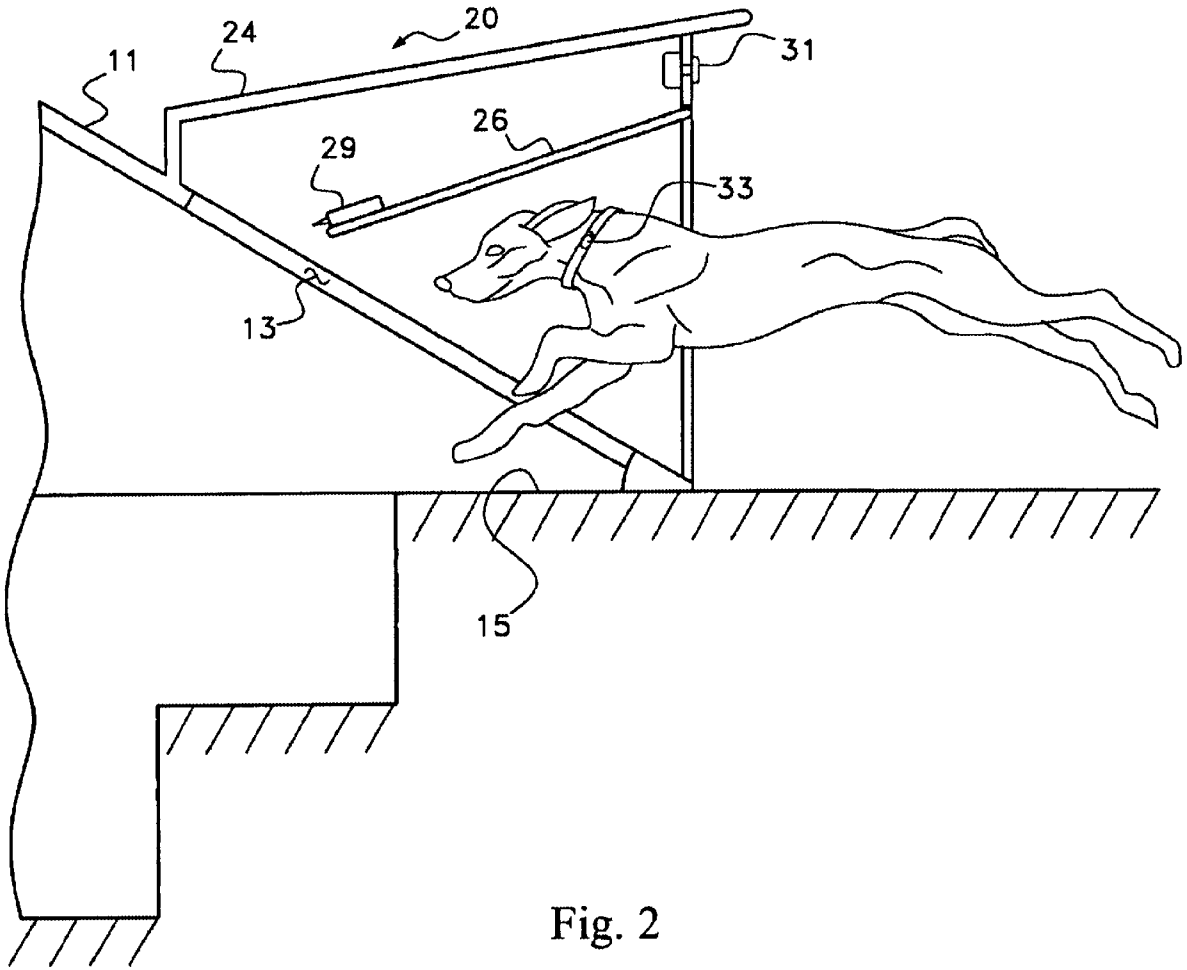
FIG. 2 is a cross-sectional view of the embodiment of the dormer structure shown in FIG. 1 as installed on an inclined cellar door.

Referring to FIG. 2, it can be seen that the dormer structure 20 and the opening 13 in the inclined cellar door 11 are positioned over the first step 15 of the cellar stairwell. The flap door 26 on the front wall 28 of the dormer structure 20 is hung from its top with a hinge that enables the flap door 26 to swing either into or out of the dormer structure 20. As a pet approaches the dormer structure 20, the pet pushes against the flap door 26. The flap door 26 swings open and the pet can either enter or exit the cellar stairwell through the dormer structure 20. The top surface 24 of the dormer structure 20 may overhang the flap door 26 to protect the flap door 26 from rain.

Since the flap door 26 is small and vertical, is highly unlikely that a child would be able to fall though the flap door 26 and then through the opening 13 in the inclined cellar door 11. As such, the presence of the dormer structure 20 prevents a child or animal from accidentally stepping on the inclined cellar door 11 and falling through the opening.

The flap door 26 can be just a free hanging door or a door that closes with a weak magnetic seal. However, the technology of prior art animal access doors can be applied to the flap door 26 in the dormer structure 20. The dormer structure 20 can be supplied with an electromechanical locking mechanism 29 that locks the flap door 26 closed. The electromechanical locking mechanism 29 can be controlled by a sensor 31 located on the dormer structure 20. The sensor 31 can detect the presence of a specialized pet collar 33 worn by a pet. The pet collar 33 can contain a magnet, transmitter or the like that can be detected by the sensor 31 when in close proximity to the sensor 31. Once the sensor 31 detects the pet's collar, the sensor 31 activates the electromechanical locking mechanism 29 and enables the pet wearing the collar 33 to pass into or out of the dormer structure 20.

Figure 3:
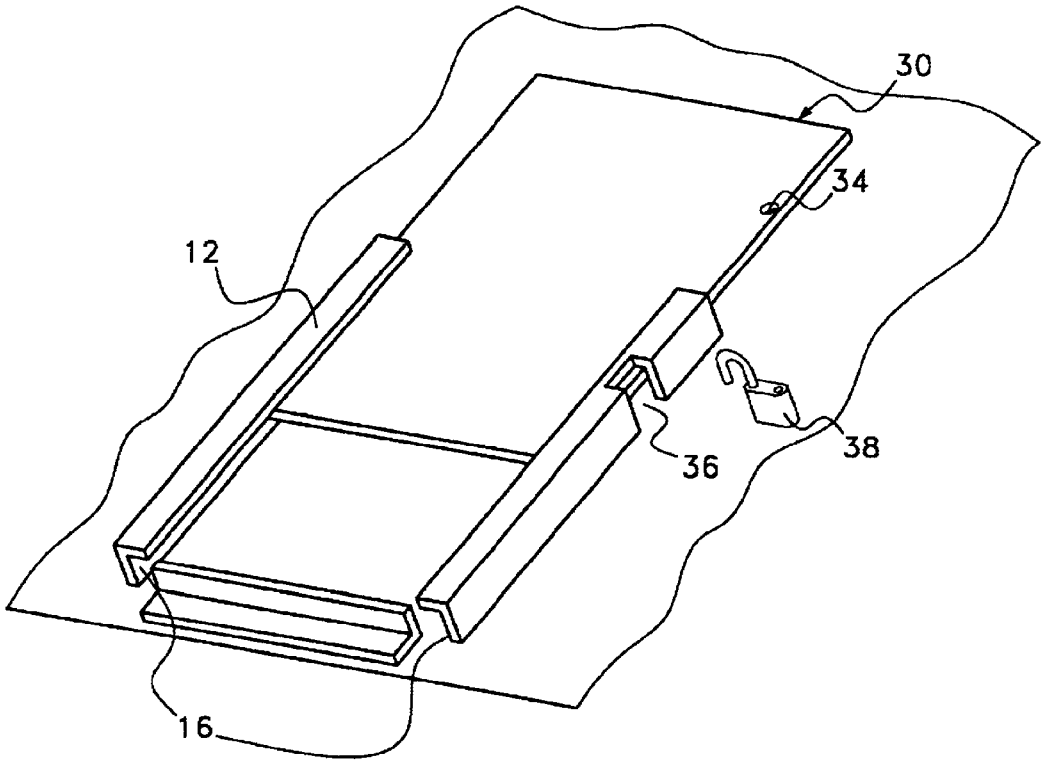
FIG. 3 is a perspective view of the embodiment of the safety panel shown in FIG. 1 as installed on an inclined cellar door.

The dormer structure 20 can be selectively removed from above the opening in the inclined cellar door 11. Referring to FIG. 3, it can be seen that once the dormer structure 20 is removed, a safety panel 30 can be placed over the cellar door opening 13. The safety panel 30 slides into the tracks 16 created by the guide rails 12. In the safety panel 30 is located a locking aperture 34. When the safety panel 30 is fully advanced into the tracks 16 of the guide rails 12, the locking aperture 34 aligns with a breach 36 in the guide rail 12. At this point, a locking pin or padlock 38 can be advanced through the locking aperture 34 and breach 36. Once in place, the padlock 38 would prevent the safety panel 30 from being removed by any unauthorized person. Although not illustrated, it should be understood that the locking aperture 34 present in the safety panel 30 can also be present in the protruding lip extension 22 (FIG. 1) of the dormer structure 20. As such, the dormer structure 20 can be locked into place in the same manner as the safety panel.

The safety panel 30 can be metal or any other material that is strong enough to withstand a person's weight who may stand on the safety panel 30 over the opening in the inclined cellar door 11.

Returning to FIG. 1, it will now be understood that to install the present invention system 10, the system 10 is first purchased from a retailer. The size of the dormer structure 20 provided in the system 10 will be dependent upon the size of the pet that will be utilizing the system 10. Initially three sizes will be available, large, for large dogs, medium, for medium sized dogs and small for small dogs and cats. Provided in the purchased systems will be the guide rails 12, the dormer structure 20 and the safety panel 30. Also provided will be instructions of how large of an opening 13 must be cut in the inclined surface prior to the installation of the system 10. Once the opening is cut, the guide rails 12 are installed using screws and/or bolts. The dormer structure 20 or the safety panel 30 can then be set into place as needed.

In the embodiment shown in FIG. 1, FIG. 2 and FIG. 3, the dormer structure 20 was attached to the inclined cellar door 11 utilizing the guide rails 12. The guide rails 12 create tracks. In this manner, the dormer structure 20 can be selectively removed and replaced with a safety panel 30 without tools. However, such a configuration is merely exemplary. It should be understood that the dormer structure 20 can be directly attached to the inclined cellar door 11 using nails, bolts and/or adhesive. In such a construction, the dormer structure would be permanently set in place and would not be replaceable with a safety panel. Consequently, mechanical fasteners, such as nails, screws and bolts can be considered attachment mechanisms for directly attaching the dormer structure 20 to an inclined cellar door. Furthermore, adhesives should also be considered attachment mechanisms for attaching the dormer structure 20 to the inclined cellar door. Accordingly, the rail guides 12, mechanical fasteners and adhesives are all attachment mechanisms within the meaning of the term set forth below in the claims.

It will also be understood that the embodiment of the present invention system illustrated and described is merely exemplary and that a person skilled in the art can make many modifications to the specific features shown. For example, the shape and size of the dormer structure can be altered in many different ways. The dormer structure can have any shape and be any size provided the dormer structure covers the opening in the cellar door and provides a vertical door to enter and exit the dormer structure. Furthermore, the flap door used in the dormer structure can be altered into a wide variety of shapes and a wide variety of locking mechanisms can be used to close the flap door. Many known prior art animal access doors and locking mechanisms can be adapted for use with the dormer structure of the present invention. Lastly, many different locking mechanisms can be used to lock the dormer structure or the safety panel in place. Any prior art device for locking an element in a track can be adapted for use with the present invention.

What is claimed is:

1. An animal ingress system for covering an opening in an inclined surface, said system comprising:

a dormer structure having, walls that define an internal space, wherein at least some walls have a basic extension protruding therefrom; and a top surface that spans said walls and covers said internal space;

a door disposed in one of said walls, wherein said door is sized to enable the passage of an animal therethrough;

rail elements that mount to said inclined surface, wherein said rail elements receive said base extension from at least some walls thereby attaching said dormer structure to said inclined surface over said opening in a manner that enables said dormer structure to be selectively removed.

2. The system according to claim 1, wherein said rail elements define tracks when mounted to said inclined surface and said base extensions slide into said tracks, thereby interconnecting said dormer structure to said inclined surface.

3. The system according to claim 1, further including a safety panel that can engage said rail elements over said opening in place of said dormer structure, thereby obstructing said opening.

4. The system according to claim 3, further including a locking mechanism for selectively locking said dormer structure to said rail elements.

5. The system according to claim 1, further including a lock for selectively locking said door in a closed position.

6. The system according to claim 5, further including a sensor for detecting the presence of a specific pet within a predetermined distance of said door and opening said lock when said pet is detected within said predetermined distance.

7. A modular pet access door system, comprising:

a dormer structure having walls and an open bottom surface that define an internal space and a top surface that covers said internal space;

lip extensions extending from at least two of said walls;

a rigid plate;

a set of rail elements that can be selectively mounted to a surface proximate an opening in said surface, wherein said set of rail elements selectively engage either said lip extensions on said walls of said dormer structure or said rigid plate to cover said opening.

8. The system according to claim 7, further including a locking mechanism for selectively locking said dormer structure to said rail elements.

* * * * *